US009899758B1

(12) United States Patent
Morello et al.

(10) Patent No.: US 9,899,758 B1
(45) Date of Patent: Feb. 20, 2018

(54) ELECTRICAL CONNECTOR SYSTEM WITH ENHANCED TERMINAL RETAINING BEAM

(71) Applicant: Delphi Technologies, Inc., Troy, MI (US)

(72) Inventors: John R. Morello, Warren, OH (US); James M. Rainey, Warren, OH (US); Gerald A. Rhinehart, Jr., Lordstown, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 15/414,701

(22) Filed: Jan. 25, 2017

(51) Int. Cl.
*H01R 13/424* (2006.01)
*H01R 13/428* (2006.01)

(52) U.S. Cl.
CPC ..... *H01R 13/424* (2013.01); *H01R 13/428* (2013.01)

(58) Field of Classification Search
CPC ..... H01R 13/4223; H01R 13/4365; H01R 12/585
USPC ..... 439/595, 751
See application file for complete search history.

(56) References Cited

U.S. PATENT DOCUMENTS 3,430,185 A * 2/1969 Berg ..... H01R 13/422 174/138 F
4,323,296 A * 4/1982 Andoh ..... H01R 13/50 439/595
4,902,247 A * 2/1990 Suzuki ..... H01R 13/5221 439/595
5,980,318 A * 11/1999 Morello ..... H01R 13/4226 439/595
6,048,225 A * 4/2000 Dechanteloup ..... B60R 16/02 439/595
7,048,584 B1 5/2006 Morello et al.
7,607,945 B2 * 10/2009 Kozono ..... H01R 13/4364 439/595
9,300,085 B2 3/2016 Morello et al.
2006/0292928 A1 * 12/2006 Morello ..... H01R 13/4226 439/595
2008/0070440 A1 * 3/2008 Morello ..... H01R 13/4223 439/595

* cited by examiner

*Primary Examiner* — Gary Paumen
(74) *Attorney, Agent, or Firm* — Robert J. Myers

(57) ABSTRACT

An electrical connector system including a first connector having a lock nib extending from a floor into a terminal cavity and a flexible member overlying the floor. The beam has two terminal hold down bumps extending into the terminal receiving cavity. The electrical connector system also includes a terminal having a lock edge. The terminal is received in the terminal cavity such that the hold down bumps engage a top surface of the terminal, applying a force that biases the terminal towards the rigid floor. The lock nib engages the lock edge, thereby preventing the terminal from being inadvertently withdrawn from the terminal cavity. A second connector defines a shroud into which a portion of the first connector is inserted, wherein the beam compressively contacts an inner surface of the second connector further increasing the force applied to the terminal. The connectors may be formed by an additive manufacturing process.

14 Claims, 6 Drawing Sheets

ELECTRICAL CONNECTOR SYSTEM WITH ENHANCED TERMINAL RETAINING BEAM

TECHNICAL FIELD OF THE INVENTION

The invention generally relates to electrical connector systems, and more particularly relates to an electrical connector system having a terminal retained within a terminal receiving cavity of a connector body.

BACKGROUND OF THE INVENTION

It is common in the prior art to provide an electrical connector having a terminal received in a terminal cavity of a connector body. The terminal may be held in the connector body by flexible locking tangs or fingers. The flexible locking tangs or fingers may be formed as a part of the terminal or the connector body. Terminals having flexible locking tangs or fingers are complicated structures to manufacture, often having at least two separate pieces to be assembled and often are large and bulky. Similarly, connector bodies having flexible locking tangs or fingers are large and bulky, and are difficult to tool and injection mold. Another disadvantage of these devices having flexible locking tangs or fingers is that the system provides only a flexible locking member engaging a rigid locking member. Unfortunately, the flexible locking member may become inadvertently disengaged, allowing the terminal to be removed from the connector body.

U.S. Pat. No. 5,980,318 discloses an electrical connector having a terminal receiving cavity defined in part by a rigid floor wall that has a rigid lock nib that extends upwardly from the rigid floor wall into the terminal receiving cavity. A flexible beam opposes the rigid floor wall, and a ceiling wall includes a terminal hold down bump extending toward the rigid floor wall at a location generally opposite the rigid lock nib. The connector body receives a terminal in each terminal receiving cavity. Each terminal has a recess defined in part by a rigid lock bar. That is attached to side walls of the terminal. The rigid lock nib is disposed in the terminal recess when the terminal is fully seated in the terminal cavity with the rigid lock bar engaging the rigid lock nib to prevent the seated terminal from being pulled out of the terminal cavity.

The invention described herein provides alternatives to and advantages over the prior art. The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

According to an embodiment, an electrical connector system is presented. The electrical connector system includes a first connector body that has a terminal receiving cavity formed therein. The terminal receiving cavity is defined in part by a rigid floor that has a rigid lock nib extending from the rigid floor into the terminal receiving cavity and a flexible member extending into the terminal receiving cavity overlying the rigid floor. The flexible beam has at least one fixed end secured to the first connector body and a contact portion. The contact portion has a first terminal hold down bump extending into the terminal receiving cavity and a second terminal hold down bump extending into the terminal receiving cavity distinct from the first terminal hold down bump. The electrical connector system also includes a terminal that has a first end configured to connect with a corresponding mating terminal, a second end configured to be secured to a wire, and a body portion intermediate the first and second ends. The body portion has a bottom surface that includes a rigid lock edge. The body portion has a top surface that has a first portion forward of the rigid lock edge and a second portion rearward of the rigid lock edge. The terminal is received in the terminal receiving cavity such that the first terminal hold down bump engages the first portion of the top surface and the second terminal hold down bump engages the second portion of the top surface, thereby biasing the terminal towards the rigid floor. The rigid lock nib engages the rigid lock edge, thereby preventing the terminal from being inadvertently withdrawn from the terminal receiving cavity.

The electrical connector system may further include a second connector body defining a connector receiving cavity. The contact portion may define a beam hold down bump located intermediate and opposed to the first and second terminal hold down bumps. The first connector body is received in the connector receiving cavity such that the beam hold down bump engages an inner surface of the connector receiving cavity, thereby further biasing the flexible beam toward the rigid floor and increasing a normal force applied by the first and second hold down bumps to the top surface of the terminal.

The first connector body may have a first face defining a first opening to the terminal receiving cavity for receiving the corresponding mating terminal therethrough and may have a second face defining a second opening to the terminal receiving cavity for receiving the terminal therethrough.

The first face may include a third opening for a channel communicating with the terminal receiving cavity. The channel is configured for insertion of an elongate tool to contact the bottom surface of the terminal in the terminal receiving cavity. The channel may be non-parallel to the rigid floor. The channel may define an acute angle relative to the rigid floor in a range of 10 to 60 degrees. The channel may enter the terminal receiving cavity forward of the rigid lock nib.

The first connector body may define a plurality of terminal receiving cavities. The first face may define a plurality of first openings and third openings to the plurality of terminal receiving cavities and does not define any other openings to the plurality of terminal receiving cavities.

The tool may be a first tool configured to confirm that the terminal is present within the terminal receiving cavity and that the bottom surface is in contact with the rigid floor. Additionally or alternatively the tool is a second tool configured to push the terminal away from the rigid floor such that the rigid lock edge disengages the rigid lock nib.

The first connector body may be formed by an additive manufacturing process such as stereolithography (SLA), digital light processing (DLP), fused deposition modeling (FDM), fused filament fabrication (FFF), selective laser sintering (SLS), selecting heat sintering (SHS), multi-jet modeling (MJM), or 3D printing (3DP).

The flexible beam may formed of a glass filled polymer material.

The rigid lock nib may have tapered sidewalls that engage sidewalls of the in the bottom surface of the terminal, thereby inhibiting lateral movement of the terminal in the terminal receiving cavity.

The terminal may be a female terminal wherein the first end is open to receive a corresponding male terminal.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
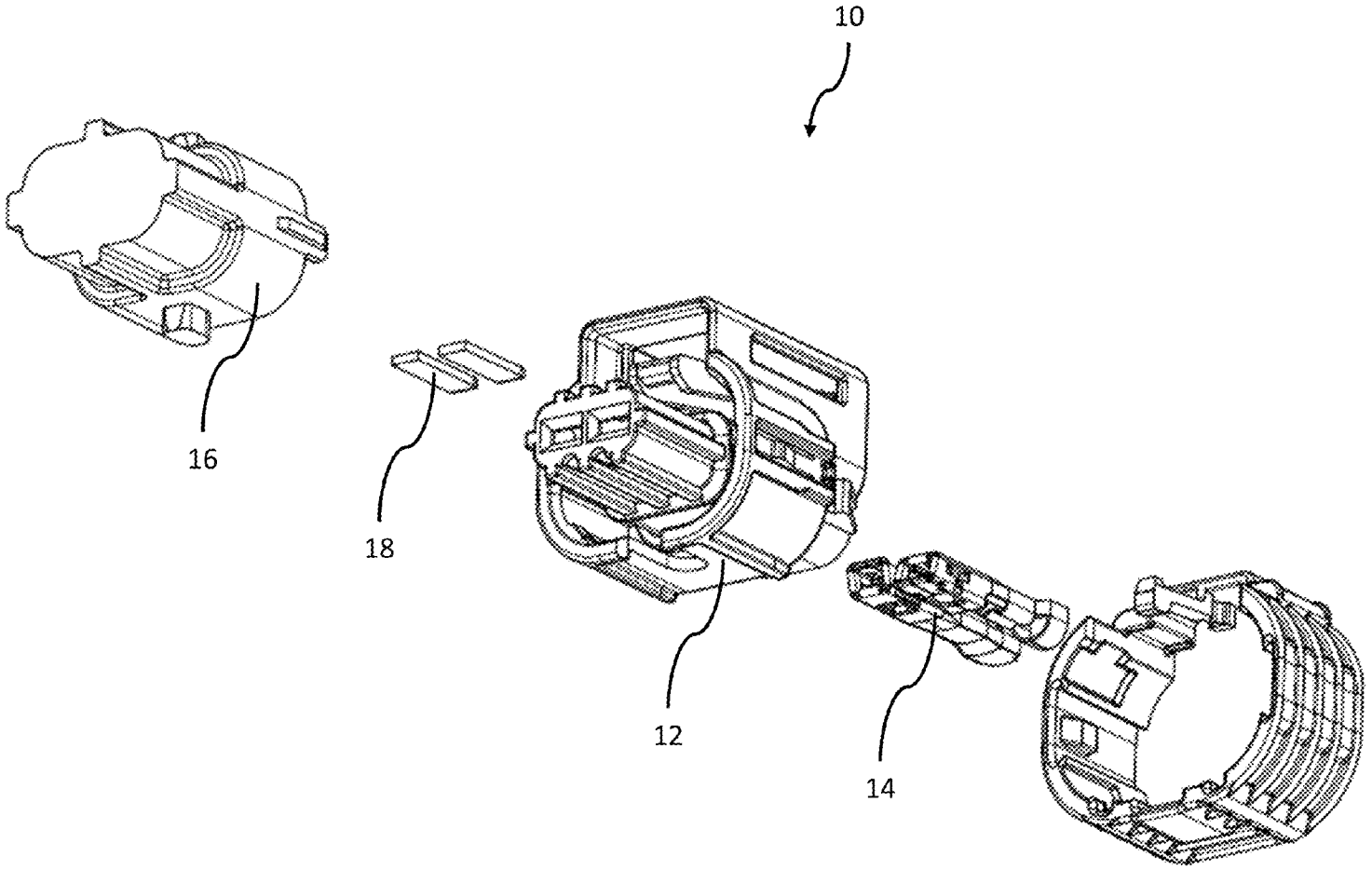
FIG. 1 is an exploded perspective view of an electrical connector system in accordance with one embodiment.

The electrical connector system described herein includes a terminal hold down beam that is configured to apply a spring force to a terminal disposed within a terminal cavity of a first connector body to maintain engagement of the terminal with a terminal lock nib that inhibits removal of the terminal from the terminal cavity. The terminal hold down beam is also configured to contact the inside surface of a shroud of a second connector body. This contact with the shroud exerts an additional force on the terminal hold down beam that holds the terminal against a floor of the terminal cavity, thereby inhibiting relative movement between the terminal and the terminal cavity caused by vibration.

In the following description, terms describing orientation such as "longitudinal" will refer to the mating axis X while "lateral" should be understood to refer to an axis perpendicular to the mating axis X, which is not necessarily the transverse axis. Furthermore, other terms such as "top" or "bottom" should be understood relative to an axis perpendicular to the mating axis X, which is not necessarily the vertical axis. As used herein the terms "front" and "forward" refer to a lateral orientation referenced from the connector body towards the corresponding mating connector body and the terms "back", "rear", "rearward", and "behind" refer to a lateral orientation referenced from the corresponding mating connector body towards the connector body.

FIGS. 1-5 illustrate a non-limiting example of an electrical connector system 10 having a first connector body 12 that holds a plurality of female electrical terminals 14 configured to terminate wire cables (not shown) and a second connector body 16 configured to mate with the first connector body 12 that holds a plurality of male electrical terminals 18 configured to interconnect with the female electrical terminals 14 within the first connector body 12.

Figure 2:
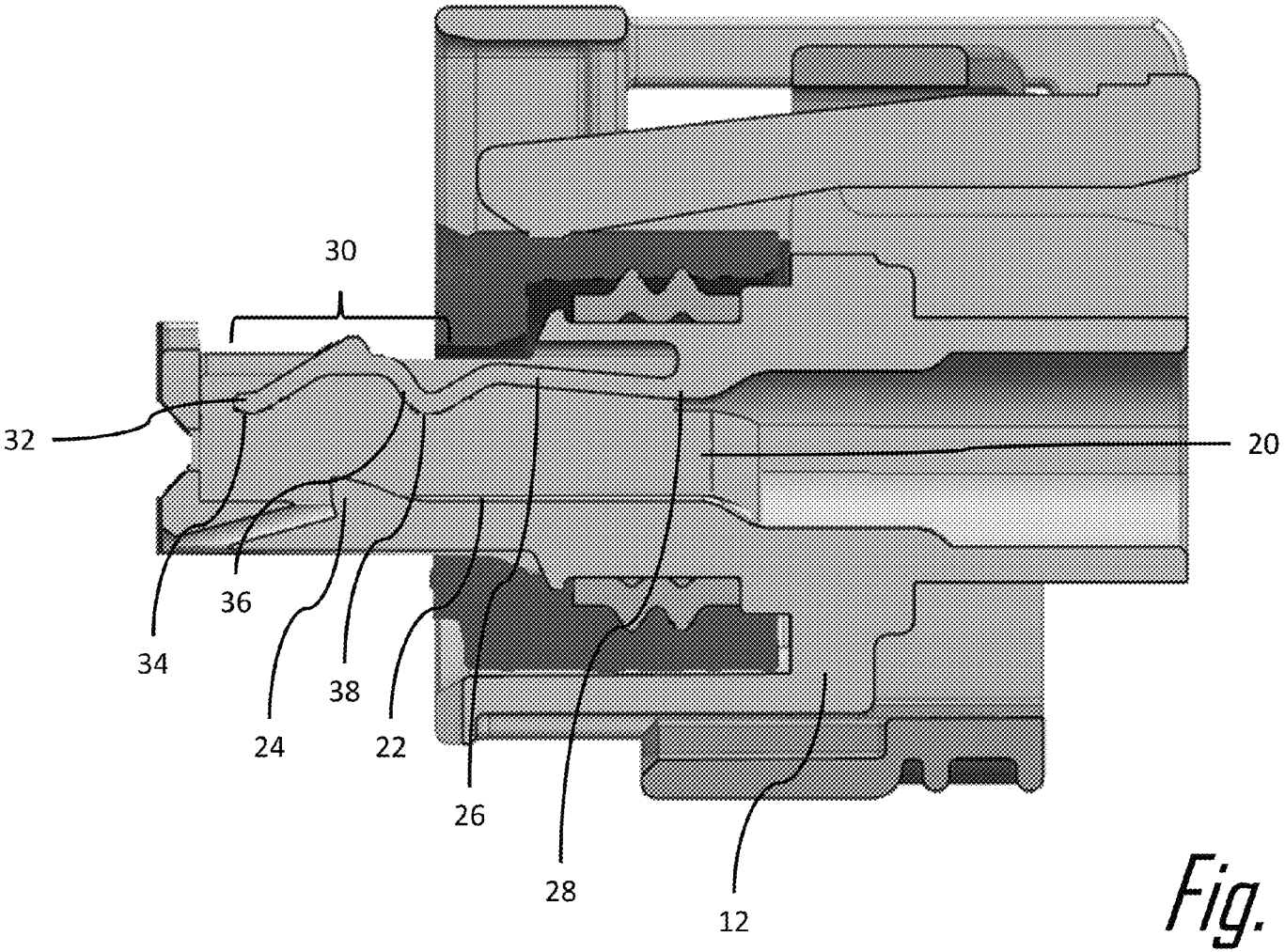
FIG. 2 is a cut-away side view of a first connector body of the electrical connector system of FIG. 1 prior to insertion of a terminal in accordance with one embodiment.

As shown in FIG. 2, the first connector body 12 that has a terminal receiving cavity 20, hereinafter referred to as the terminal cavity 20, formed therein. The terminal cavity 20 is defined in part by a rigid floor 22 that has a rigid lock nib 24 extending from the floor 22 into the terminal cavity 20. The terminal cavity 20 also includes a flexible member 26, hereinafter referred to as a terminal hold down beam 26, that extends into the terminal cavity 20 and overlies the floor 22 of the terminal cavity 20. The terminal hold down beam 26 has a fixed end 28 that is secured to the first connector body 12 and a contact portion 30 that is terminated by a free end 32 of the terminal hold down beam 26. The free end 32 extends downwardly into the terminal cavity 20 toward the floor 22 and has a rounded end forming a first terminal hold down bump 34. The contact portion 30 also includes a J-shaped protrusion 36 that extends downwardly from the terminal hold down beam 26 at a location rearward of the first terminal hold down bump 34. The J-shaped protrusion 36 has a rounded end forming a second terminal hold down bump 38. The terminal hold down beam 26 shown here is a cantilevered flexible beam but other embodiments of the invention may be envisioned in which the terminal hold down beam is a fixed flexible beam.

The illustrated female terminal 14 has an open end 40 that is configured to receive the corresponding male terminal 18, an attachment end 42, and a body portion 44 intermediate the open and attachment ends 40, 42. The body portion 44 has a bottom surface 46 that includes a recess 48 or opening defined therein that is configured to receive the lock nib 24. The recess 48 defines a rigid lock edge 50 in the bottom surface 46 with which the lock nib 24 engages. The body portion 44 also has a top surface 52 that has a first portion 54 that is located forward of the lock edge and a second portion 56 that is located rearward of the lock edge 50. The attachment end 42 illustrated here comprises a pair of crimping wings that are configured to be mechanically crimped to the stands of the wire. Other means for attaching the wire to the terminal 14, such as soldering or sonic welding may be used and the design of the attachment end 42 may be revised accordingly. The terminal 14 may be formed of a sheet of a conductive material, such as a tin plated copper material, by a process of stamping and bending. While the embodiment illustrated in FIG. 2 is a female socket terminal 14 configured to receive a male blade terminal 18, other embodiments of the electrical connector system may be envisioned using other terminal types. Further, while the terminal 14 illustrated in FIG. 2 has a lock edge defined by a recess 48 in the bottom surface 46 of the terminal 14, alternative embodiments may be envisioned wherein the lock edge is defined by the rear edge of the body of the terminal.

As the terminal 14 is received in the terminal cavity 20, the bottom surface 46 of the terminal 14 contacts the inclined rearward surface of the lock nib 24 and the top surface 52 contacts the inclined rearward surface of the second terminal hold down bump 38. As the terminal 14 is pushed into the terminal cavity 20, the terminal 14 is pushed upwardly in the terminal cavity 20 by the lock nib 24 and causing the terminal hold down beam 26 to flex upwardly. After the lock edge 50 is pushed beyond the ridge formed by the junction of the rearward and forward surfaces of the lock nib 24, the terminal 14 hold down beam 26 springs back to a partially deflected position and the lock nib 24 is received into the recess 48 such that the lock edge engages the lock nib 24, thereby preventing the terminal from being inadvertently withdrawn from the terminal cavity 20. When the lock nib 24 is received within the recess 48, the first terminal hold down bump 34 engages the first portion 54 of the top surface 52 and the second terminal hold down bump 38 engages the second portion 56 of the top surface 52 and the terminal hold down beam 26 remains partially flexed and exerts a spring force on the terminal 14 through the first and second terminal hold down bumps 34, 38, thereby biasing the terminal 14 towards the floor 22. The spring force exerted on the terminal 14 by the terminal hold down beam 26 is sufficient to retain the terminal 14 within the terminal cavity 20 during the assembly of the first connector body 12 to the second connector body 16.

Figure 3:
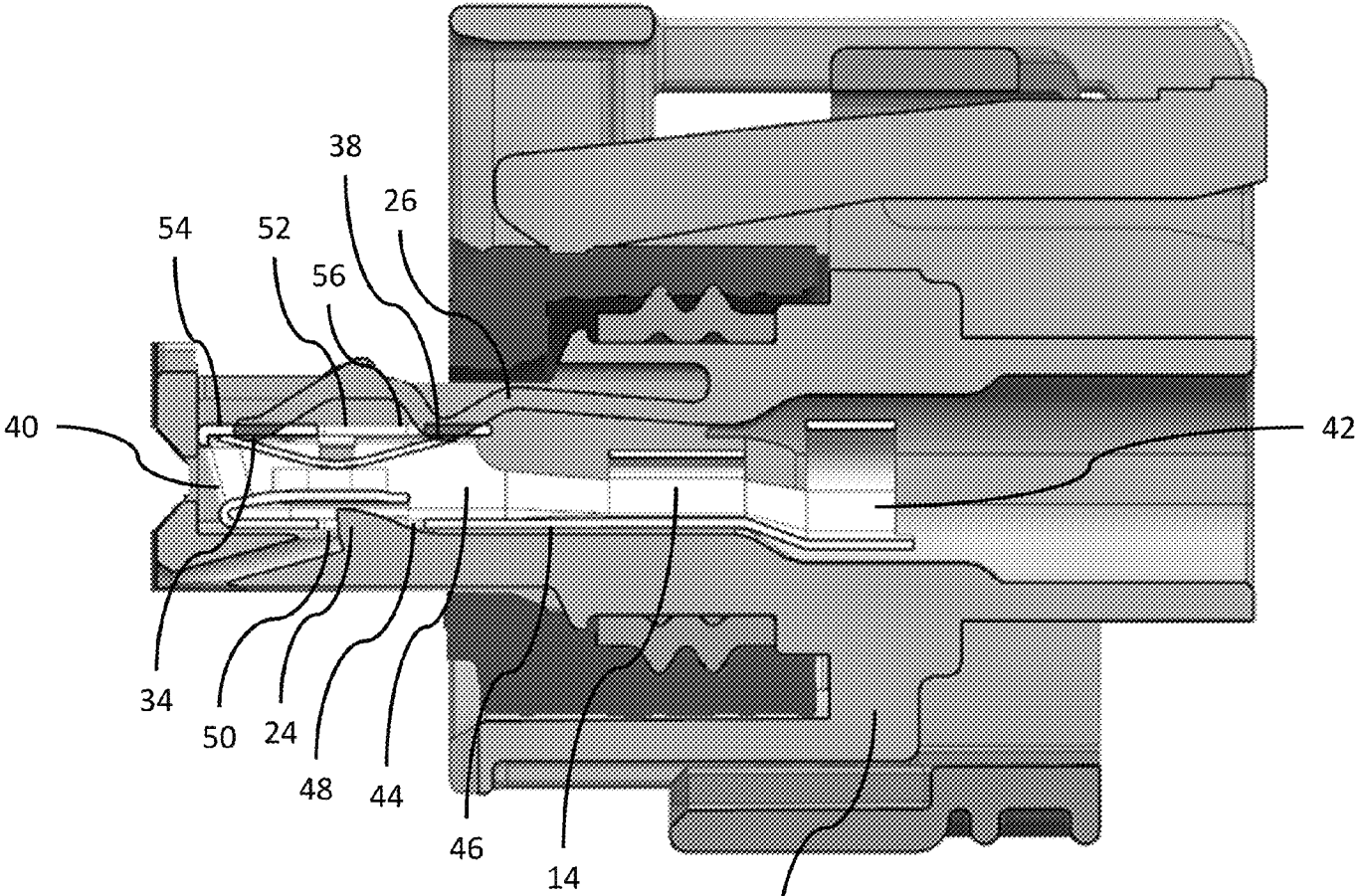
FIG. 3 is a cut-away side view of the first connector body of FIG. 2 after insertion of the terminal and prior to insertion of the first connector body into a second connector body of the electrical connector system of FIG. 1 in accordance with one embodiment.
Figure 4:
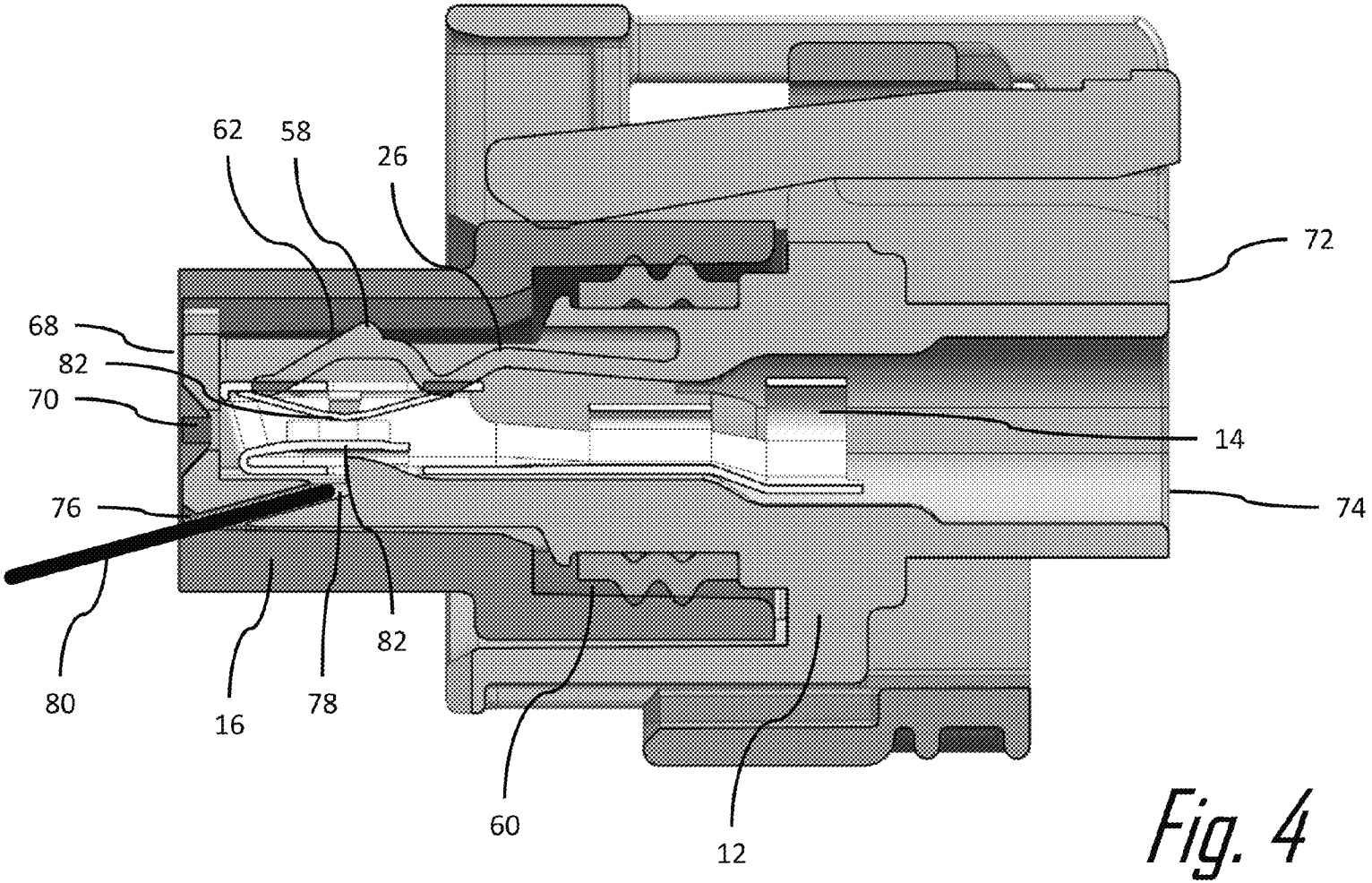
FIG. 4 is a cut-away side view of the first and second connector bodies of the electrical connector system of FIG. 1 after insertion of the first connector body into the second connector body in accordance with one embodiment.

As illustrated in FIGS. 3 and 4, the contact portion 30 defines a beam hold down bump 58 on the upper side of the terminal hold down beam 26 located intermediate and opposed to the first and second terminal hold down bumps 34, 38. The beam hold down bump 58 extends beyond the first connector body 12. As the first connector body 12 is received in a connector receiving cavity 60, hereinafter referred to as the shroud 60 of the second connector body 16, the beam hold down bump 58 compressively engages an inner surface 62 of the shroud 60. This compressive contact between the beam hold down bump 58 and the inner surface 62 of the shroud 60 generates a compressive force on the contact portion 30 of the terminal hold down beam 26 that causes an increase in the normal force applied by the first and second hold down bumps 34, 38 to the top surface 52 of the terminal 14. Without subscribing to any particular theory of operation, this increased normal force inhibits relative motion between the terminal 14 and the terminal cavity 20 that may be caused by vibration.

Figure 5:
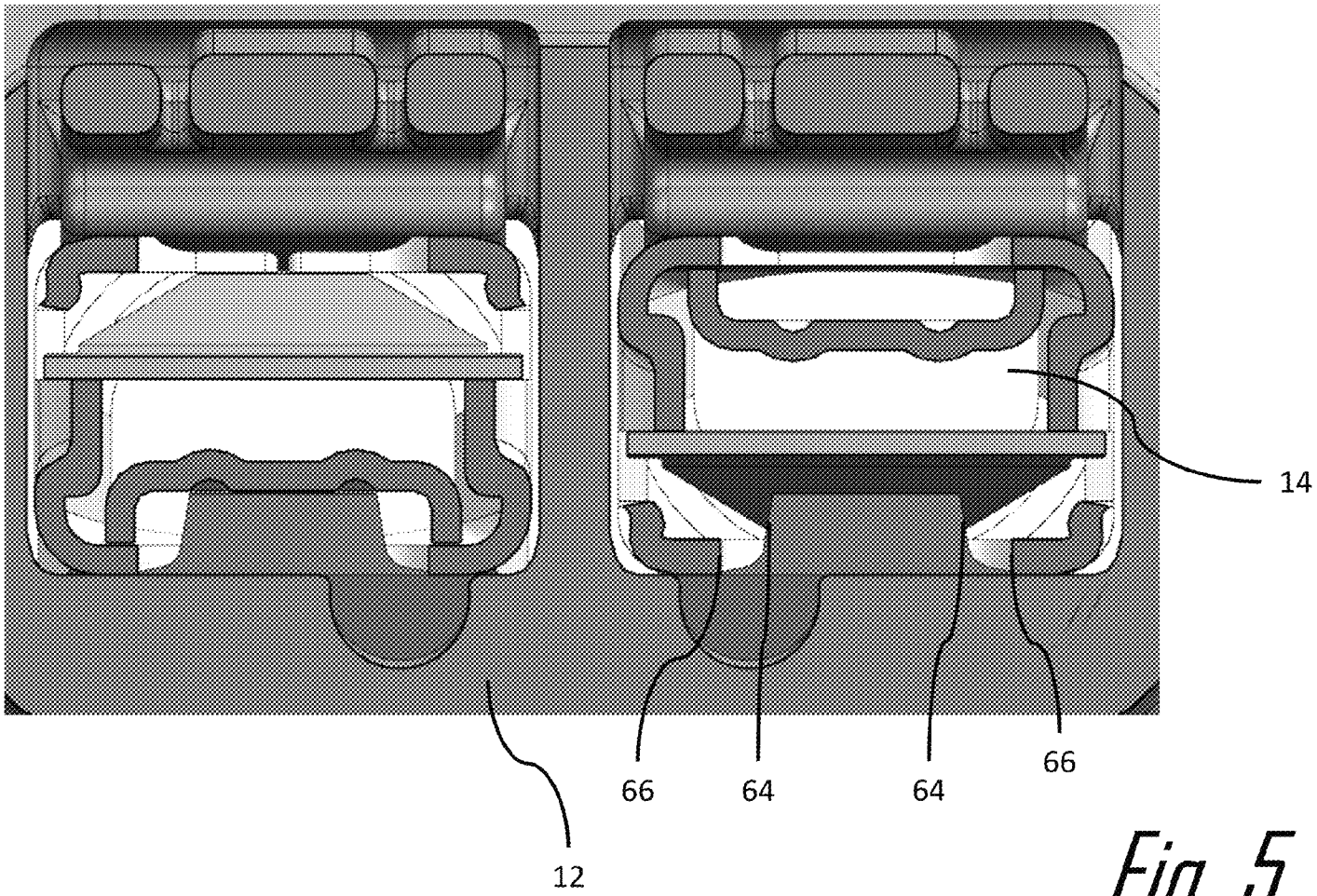
FIG. 5 is a cut-away end view of the a terminal receiving cavity of the first connector body of the electrical connector system of FIG. 1 in accordance with one embodiment.
Figure 6B:
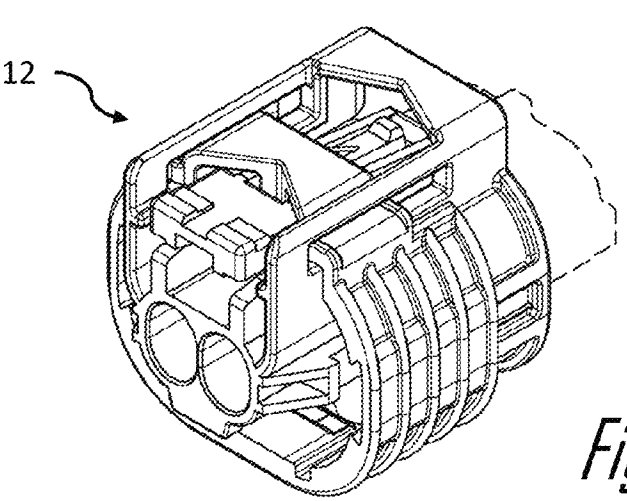
FIG. 6B is a perspective view of the first connector body of the electrical connector system of FIG. 1 in accordance with one embodiment.
Figure 6A:
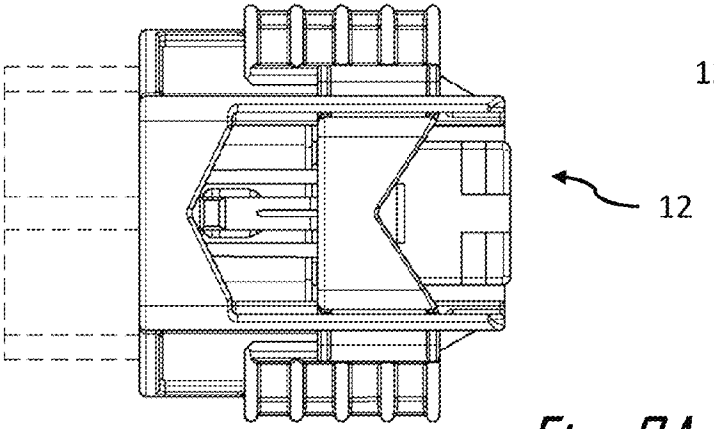
FIG. 6A is a top view of the first connector body of the electrical connector system of FIG. 1 in accordance with one embodiment.
Figure 6D:
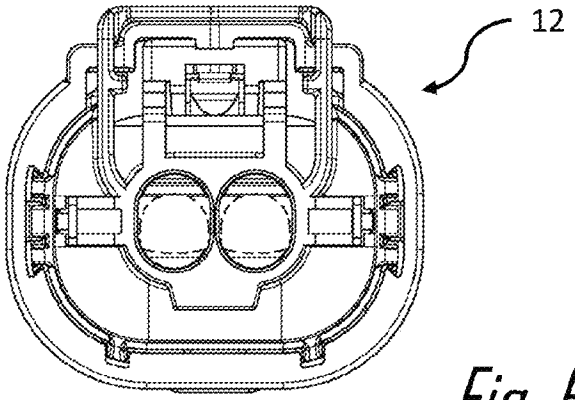
FIG. 6D is an end view of the first connector body of the electrical connector system of FIG. 1 in accordance with one embodiment.
Figure 6C:
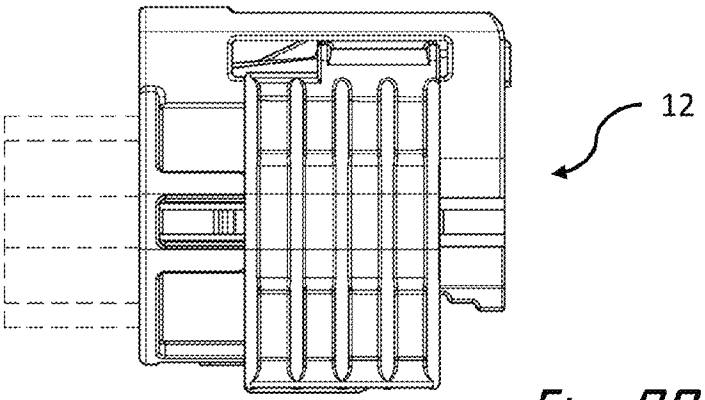
FIG. 6C is a bottom view of the first connector body of the electrical connector system of FIG. 1 in accordance with one embodiment.

As shown in FIG. 5, the side walls of the lock nib 24 defines a lateral wedge 64. The sides of the wedge 64 taper away from the side walls of the terminal cavity 20 adjacent the floor 22 and are configured to engage two sidewalls 66 of the recess in the bottom surface 46 of the terminal 14. The sides of the wedge 64 are in intimate contact with the two sidewalls 66 of the recess 48. Without subscribing to any particular theory of operation, the engagement of the wedge 64 with the recess 48 inhibits lateral movement of the terminal 14 within the terminal cavity 20. In combination with the lock edge 50 which limits longitudinal motion of the terminal 14 and the terminal hold down beam 26 which limits vertical motion of the terminal 14, the movement of the terminal 14 within the terminal cavity 20 is inhibited in three orthogonal axes.

Referring once more to FIG. 4, the first connector body 12 has a front face 68 that defines a first opening 70 to the terminal cavity 20 that is configured to for receiving the corresponding male terminal 18 therethrough and has a rear face 72 defining a second opening 74 to the terminal cavity 20 configured for receiving the terminal therethrough. The front face 68 also defines a third opening 76 for a channel 78 leading from the front face 68 to the terminal cavity 20. The channel 78 is configured for insertion of an elongate tool 80 to contact the bottom surface 46 of the terminal 14 in the terminal cavity 20. The front face 68 does not define any other openings to terminal cavities 20 other than first and third openings 70, 76.

The channel 78 is non-parallel to the floor 22 of the terminal cavity 20. The channel 78 defines an acute angle relative to the floor 22 that is in a range of 10 to 60 degrees. The channel 78 enters the terminal cavity 20 forward of the lock nib 24. The tool 80 may be used for at least two different purposes. The tool 78 may be used to confirm that the terminal 14 is present within the terminal cavity 20 and that the bottom surface 46 is in contact with the floor 22. The tool 80 may be a gauge that indicates the proper depth of insertion into the channel 78 at which the presence of the terminal 14 is properly detected. The tool 80 may additionally or alternatively be a conductive tool configured to test electrical continuity between and energized terminal 14 and the tool 80. Additionally or alternatively the tool 80 may be used to push the terminal 14 away from the floor 22 such that the lock edge 50 disengages the lock nib 24, allowing the terminal 14 to be removed from the terminal cavity 20 through the second opening 74. Because the tool 80 is configured to contact the bottom surface 46 of the terminal 14, the tool 80 is unlikely to cause damage to the mating surfaces 82 in the open end 40 of the terminal 14 that are accessible through the first opening.

The first connector body 12, including the terminal hold down beam 26, is preferably formed of a glass filled polymeric material. The shape of the terminal hold down beam 26 with the first and second terminal hold down bumps 34, 38 extending from the beam 26 would be very difficult to form using conventional injection molding technology due the complexity of the mold that would be required to form the desired shapes, therefore, the first connector body 12 is preferably formed by an additive manufacturing process such as stereolithography (SLA), digital light processing (DLP), fused deposition modeling (FDM), fused filament fabrication (FFF), selective laser sintering (SLS), selecting heat sintering (SHS), multi-jet modeling (MJM), or 3D printing (3DP).

While the first and second connector bodies 12, 16 illustrated herein define a pair of terminals 14, cavities 20, and associated structures, other embodiments of the connector system may be envisioned having a single terminal or more than two terminals. The more than two terminals may be arranged in several different rows and columns.

Accordingly an electrical connector assembly 10 is provided. The connector system 10 is configured to limiting motion of the terminal 14 within the terminal cavity 20 which provides the benefit of decreasing fretting corrosion between the terminal 14 and a corresponding mating terminal 18 of a mating electrical connector 16 due to vibration. The electrical connector assembly 10 also provides the benefit of a lower terminal insertion force since the terminal 14 only needs to overcome the spring force of the terminal hold down beam 26 when it is inserted into the terminal cavity 20 while the force exerted on the terminal 14 by the terminal hold down beam 26 is increased when the first connector body 12 is inserted within the second connector body 16 and the inner surface 62 of the shroud 60 presses down on the terminal hold down beam 26. The angled channel 78 further provides the benefits of accessing the bottom surface 46 of the terminal 14 to verify placement of the terminal 14 in the terminal cavity 20 and removing the terminal 14 from the terminal cavity 20 without contacting the mating surfaces 82 of the terminal 14, eliminating the opportunity to damage the mating surfaces 82 of the terminal 14 by the tool 80. Forming the first connector body 12 using an additive manufacturing processes also allows the terminal hold down beam 26 to be shaped in a configuration that may be difficult or impossible to obtain with conventional injection molding techniques.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. An electrical connector system, comprising:

a first connector body having a terminal receiving cavity formed therein, the terminal receiving cavity being defined in part by a rigid floor having a rigid lock nib extending from the rigid floor into the terminal receiving cavity and a flexible member extending into the terminal receiving cavity overlying the rigid floor, said flexible beam having at least one fixed end secured to the first connector body and a contact portion, said contact portion having a first terminal hold down bump extending into the terminal receiving cavity and a second terminal hold down bump extending into the terminal receiving cavity distinct from the first terminal hold down bump; and a terminal having a first end configured to connect with a corresponding mating terminal, a second end configured to be secured to a wire, and a body portion intermediate the first and second ends, said body portion having a bottom surface defining a rigid lock edge, said body portion having a top surface having a first portion forward of the rigid lock edge and a second portion rearward of the rigid lock edge, wherein the terminal is received in the terminal receiving cavity such that the first terminal hold down bump engages the first portion of the top surface and the second terminal hold down bump engages the second portion of the top surface, thereby biasing the terminal towards the rigid floor and wherein the rigid lock nib engages the rigid lock edge, thereby preventing the terminal from being inadvertently withdrawn from the terminal receiving cavity.

2. The electrical connector system according to claim 1, wherein the electrical connector system further compromises a second connector body defining a connector receiving cavity, wherein the contact portion defines a beam hold down bump intermediate and opposed to the first and second terminal hold down bumps, and wherein the first connector body is received in the connector receiving cavity such that the beam hold down bump engages an inner surface of the connector receiving cavity, thereby further biasing the flexible beam toward the rigid floor and increasing a normal force applied by the first and second hold down bumps to the top surface of the terminal.

3. The electrical connector system according to claim 2, wherein the first connector body has a first face defining a first opening to the terminal receiving cavity for receiving the corresponding mating terminal therethrough and a second face defining a second opening to the terminal receiving cavity for receiving the terminal therethrough.

4. The electrical connector system according to claim 3, wherein the first face includes a third opening for a channel communicating with the terminal receiving cavity, said channel configured for insertion of an elongate tool to contact the bottom surface of the terminal in the terminal receiving cavity.

5. The electrical connector system according to claim 4, wherein the channel is non-parallel to the rigid floor.

6. The electrical connector system according to claim 5, wherein the channel defines an acute angle relative to the rigid floor in a range of 10 to 60 degrees.

7. The electrical connector system according to claim 4, wherein the channel enters the terminal receiving cavity forward of the rigid lock nib.

8. The electrical connector system according to claim 4, wherein the first connector body defines a plurality of terminal receiving cavities and wherein the first face defines a plurality of first openings and third openings to the plurality of terminal receiving cavities and does not define any other openings to the plurality of terminal receiving cavities.

9. The electrical connector system according to claim 4, wherein the tool is a first tool configured to confirm that the terminal is present within the terminal receiving cavity and that the bottom surface is in contact with the rigid floor.

10. The electrical connector system according to claim 4, wherein the tool is a second tool configured to push the terminal away from the rigid floor such that the rigid lock edge disengages the rigid lock nib.

11. The electrical connector system according to claim 1, wherein the first connector body is formed by an additive manufacturing process selected from a list consisting of stereolithography (SLA), digital light processing (DLP), fused deposition modeling (FDM), fused filament fabrication (FFF), selective laser sintering (SLS), selecting heat sintering (SHS), multi-jet modeling (MJM), and 3D printing (3DP).

12. The electrical connector system according to claim 11, wherein the flexible beam is formed of a glass filled polymer material.

13. The electrical connector system according to claim 1, wherein tapered sidewalls of the rigid lock nib engage recess sidewalls in the bottom surface of the terminal, thereby inhibiting lateral movement of the terminal in the terminal receiving cavity.

14. The electrical connector system according to claim 1, wherein the terminal is a female terminal and wherein the first end is open to receive a corresponding male terminal.

* * * * *